US007210256B2

(12) United States Patent
Rosserot

(10) Patent No.: US 7,210,256 B2
(45) Date of Patent: May 1, 2007

(54) ARTIFICIAL FIREPLACE

(75) Inventor: Jean Pierre Rosserot, Montreal (CA)

(73) Assignee: Elite Group, Inc., Montreal (CA)

( * ) Notice: Subject to any disclaimer, the term of this patent is extended or adjusted under 35 U.S.C. 154(b) by 26 days.

(21) Appl. No.: 11/064,891

(22) Filed: Feb. 24, 2005

(65) Prior Publication Data

US 2006/0098428 A1 May 11, 2006

Related U.S. Application Data

(63) Continuation-in-part of application No. 10/982,287, filed on Nov. 5, 2004.

(51) Int. Cl.
*G09F 19/00* (2006.01)

(52) U.S. Cl. ..... 40/428; 362/96; 362/806

(58) Field of Classification Search ..... 362/96, 362/262, 806; 40/428, 429, 430, 431, 436, 40/439, 440, 441
See application file for complete search history.

(56) References Cited

U.S. PATENT DOCUMENTS

| | | | | |
|---|---|---|---|---|
| 2,684,244 | A * | 7/1954 | Brooks | 40/428 |
| 2,984,032 | A | 5/1961 | Cornell | |
| 3,526,984 | A * | 9/1970 | Nielsen et al. | 40/428 |
| 3,699,697 | A * | 10/1972 | Painton | 40/428 |
| 5,924,784 | A | 7/1999 | Chliwnyj et al. | |
| 6,129,079 | A * | 10/2000 | French et al. | 126/502 |
| 6,688,752 | B2 | 2/2004 | Moore | |
| 6,693,551 | B2 * | 2/2004 | Pederson | 340/815.45 |
| 6,719,443 | B2 | 4/2004 | Gutstein et al. | |
| 6,968,123 | B2 * | 11/2005 | Ravnbo-West et al. | 392/348 |
| 2001/0033488 | A1 | 10/2001 | Chliwnyj et al. | |
| 2003/0126775 | A1 | 7/2003 | Corry et al. | |
| 2005/0097792 | A1 | 5/2005 | Naden | |
| 2006/0153547 | A1 * | 7/2006 | O'Neill | 392/348 |

FOREIGN PATENT DOCUMENTS

| | | |
|---|---|---|
| EP | 1 225 389 A1 | 7/2002 |
| GB | 2 169 700 A1 | 7/1986 |
| GB | 2264555 A | 9/1993 |
| GB | 2 321 700 A | 8/1998 |
| GB | 2322188 A | 8/1998 |
| GB | 2350670 A | 12/2000 |
| GB | 2372805 A | 9/2002 |

* cited by examiner

OTHER PUBLICATIONS

European Search Report (Application No. EP 05 10 3522), dated Nov. 11, 2005 (2 pages).

*Primary Examiner*—Renee Luebke
*Assistant Examiner*—Gunyoung T. Lee
(74) *Attorney, Agent, or Firm*—Cook, Alex, McFarron, Manzo, Cummings & Mehler, Ltd.

(57) ABSTRACT

An artificial fireplace for simulating flaming logs has a housing containing a solid state light source, a rotating flame simulation assembly, a viewing screen, and a simulated fuel source. The solid state light source preferably comprises light emitting diodes (LEDs) affixed to a printed circuit board. The light produced by the LEDs reflects off of the rotating flame simulation assembly and an image of a flame is transmitted onto the viewing screen. This design creates a realistic, randomly-flickering flame image above the simulated fuel source. Optional features include a dimmer assembly to adjust the intensity of the image and a second light source to simulate smoldering embers within the simulated fuel source. This design eliminates the problems associated with using a light bulb for a light source by instead using LEDs with a longer life span which emit less undesirable heat and consume less electricity.

22 Claims, 3 Drawing Sheets

ARTIFICIAL FIREPLACE

CROSS REFERENCE TO RELATED APPLICATION

This is a continuation-in-part application of application Ser. No. 10/982,287, filed Nov. 5, 2004.

FIELD OF THE INVENTION

This invention generally relates to artificial fireplaces.

BACKGROUND OF THE INVENTION

Fireplaces are common household devices that are used to provide heat and a pleasing aesthetic. However, traditional fireplaces are expensive, create smoke, and are a fire hazard so artificial fireplaces or stoves are popular alternatives. Artificial fireplaces are less expensive than traditional fireplaces and they do not use actual flames, so there is no smoke or fire hazard.

Typically, an artificial fireplace is formed from a ceramic housing with a viewing aperture and a hollow interior. The ceramic housing contains a light source, a viewing screen, a flame simulation device, and a simulated fuel source. The light source is disposed on the bottom of the interior of the housing, underneath the flame simulation device and between the viewing screen and the rear of the housing. The light emitted by the light source bounces off of the flame simulation device and projects the image of the flame simulation device onto the viewing screen. The simulated fuel source, which is typically shaped as one or more wooden logs, is disposed adjacent to the viewing screen and positioned such that it appears the flames projected on the screen are emanating from the logs. The simulated fuel source additionally serves to conceal the operation of the light source and flame simulation device.

The prior art artificial fireplace is shown in FIGS. 1 and 2. FIG. 1 is a side elevational view of an artificial fireplace, shown in section to better illustrate the placement and function of the various components. The housing 20 of the artificial fireplace 22 defines a hollow cavity 24 which contains a light source 26, a flame simulation assembly 28 generally above the light source 26, a simulated fuel source 32 located so as to conceal the light source 26 and the flame simulation assembly 28 from the field of vision 34 through the viewing aperture 36, and a viewing screen 38 located between the light source 26 and the simulated fuel source 32. The light source 26 and the flame simulation assembly 28 are operatively coupled to suitable power sources, which are not shown. The light source 26 emits light 40 that strikes some of the flame elements 42 affixed to the flame simulation assembly 28. The light 40 reflects off of the flame elements 42 and an image of the flame elements 42 is projected onto the viewing screen 38 at a point generally above the simulated fuel source 32. The end result is the appearance that there are flames emanating from the simulated fuel source 32. The flame simulation assembly 28 rotates, which causes the light 40 to strike the flame elements 42 at different angles as they move. The result is the appearance of motion within the image that is projected onto the viewing screen 38. Typically, the viewing screen 38 is made of glass or plastic and comprises a transparent surface which faces the viewing aperture 36 and a diffusing surface which faces the rear of the housing 20. In some prior art artificial fireplaces 22, there is also a fuel light source 44 located within the simulated fuel source 32 which projects light 40 through small apertures 46 in the simulated fuel source 32 for creating the appearance of smoldering embers. Additionally, some prior art artificial fireplaces 22 also include a dimmer assembly which can be used to selectively adjust the brightness of the flame image and/or the brightness of the simulated embers.

FIG. 2 is a front perspective view of the prior art light source 26 and flame simulation assembly 28. As illustrated in FIG. 2, the prior art light source 26 is typically one or more light bulbs 48. The flame simulation assembly 28 essentially comprises a shaft 50 that is journaled in a bearing 52 in one leg 54 of a U-shaped frame 56. The other end of the shaft 50 extends through a hole 58 in the other leg 60 of the frame 56 and is operatively coupled to a motor 62 which causes the shaft 50 to rotate about its axis. Also typically provided, but not shown, is a control assembly for selectively adjusting the speed at which the shaft 50 rotates. Affixed to the shaft 50 are several irregularly-shaped flame elements 42 which are made of a material suitable for reflecting the light 40 emitted by the light source 26. As a result of the flame elements 42 rotating as the light 40 strikes them, the flame image projected onto the viewing screen 38 appears to flicker and move.

Heretofore, the biggest problem with artificial fireplaces is that they do not produce a realistic flame image. One known method of producing a more randomly-moving, and therefore more realistic, flame image is to use a rotating shaft with attached flame elements to simulate flickering flames, as can be seen in U.S. Pat. No. 2,984,032. The light from the light source strikes the irregularly-shaped flame elements at different angles as they rotate, which results in a flame image that appears to leap and change shape. While this creates the image of a flickering flame, the image is not realistic because the result is an orange glow. A flame contains a variety of colors; primarily orange and red, but there are also instances of blue and green in places. The usual light source in an artificial fireplace is a monochromatic light bulb, which results in an unrealistic orange glow. Some prior art fireplaces attempt to create a multi-colored flame by using rotating flame elements of different colors, but this does not produce a realistic flame image. Alternatively, some prior art fireplaces use stationary flame elements and instead produce the illusion of flickering flames with a light source which flickers or blinks in a predetermined pattern or at random intervals. This results in an unsatisfactory flame effect and disadvantageously shortens the lifespan of the light source by repeatedly cycling it on and off.

In addition, there are other problems associated with using one or more light bulbs as a light source. First, light bulbs have a relatively short life span and they must be replaced frequently. This life span is further shortened when the light source is designed to flicker or blink randomly or in a pre-selected pattern. Furthermore, light bulbs produce a fair amount of heat and, depending on the material used to form the components disposed within the fireplace, this can create a fire hazard. Finally, light bulbs consume more electricity than do other light-producing devices. Therefore, there is a need for an artificial fireplace with a light source that produces a realistic multi-colored flame image and lasts longer, operates more efficiently, and generates less undesirable heat than traditional light sources.

It is accordingly a general aspect or object of the present invention to provide an artificial fireplace which produces a more realistic flame image.

Another aspect or object of this invention is to provide an artificial fireplace with a light source which has a superior life span compared to prior art light sources.

Another aspect or object of the present invention is to provide an artificial fireplace with an improved light source that produces less undesirable heat within the interior cavity of the fireplace than prior art light sources.

Another aspect or object of the present invention is to provide an artificial fireplace with an improved light source that consumes less electricity than prior art light sources.

Other aspects, objects and advantages of the present invention will be understood from the following description according to the preferred embodiments of the present invention, specifically including stated and unstated combinations of the various features which are described herein, relevant information concerning which is shown in the accompanying drawings.

SUMMARY OF INVENTION

The present invention relates to an artificial fireplace which operates similarly to prior art fireplaces, but utilizes a solid state light source, which differs from traditional incandescent light sources by deriving light from a solid object rather than from a vacuum tube. Preferably, a plurality of light emitting diodes (LEDs) removably mounted to a printed circuit board (PCB) serve as a solid state light source to produce a more realistic flame image. Each LED, when operative, emits light having a generally constant brightness (as opposed to a flickering or blinking light). This generally constant level of brightness may be manually adjusted with an optional dimmer assembly.

The preferred embodiment of the invention is an artificial fireplace with this improved light source located at the bottom of the hollow interior cavity of the fireplace. The light source is disposed generally beneath a horizontal shaft which carries a plurality of flame elements. The horizontal shaft is operatively coupled to and rotated by a motor, such that the light from the LEDs strikes some of the flame elements as they rotate into the path of the beams of light from the LEDs. Preferably, the flame elements are constructed of a light-reflecting material, such as aluminum, so the light reflects off of some of the elements and their image is transmitted to the viewing screen. In a preferred embodiment the viewing screen is made of a transparent material, such as glass or plastic, and comprises a transparent surface facing the viewing aperture and a diffusing surface which faces the rear of the housing and can be made of plastic foil. A simulated fuel source, which takes the form of a plurality of wooden logs in the preferred embodiment, conceals the operation of the light source and flame elements. Additionally, the simulated fuel source may be generally hollow for housing a second set of LEDs which simulate glowing embers. Preferably, the majority of the LEDs used to simulate the flames are red or orange, but some may be green or blue in order to produce the realistic image of a flickering orange and red flame with instances of green and blue. Besides creating a more realistic flame image, LEDs can be used approximately ten times longer than incandescent light bulbs before replacement, they produce less undesirable heat inside of the fireplace, and they consume approximately 15–20% of the electricity of an incandescent light bulb.

BRIEF DESCRIPTION OF THE DRAWINGS

In the course of this description, reference will be made to the accompanying drawings, wherein.

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
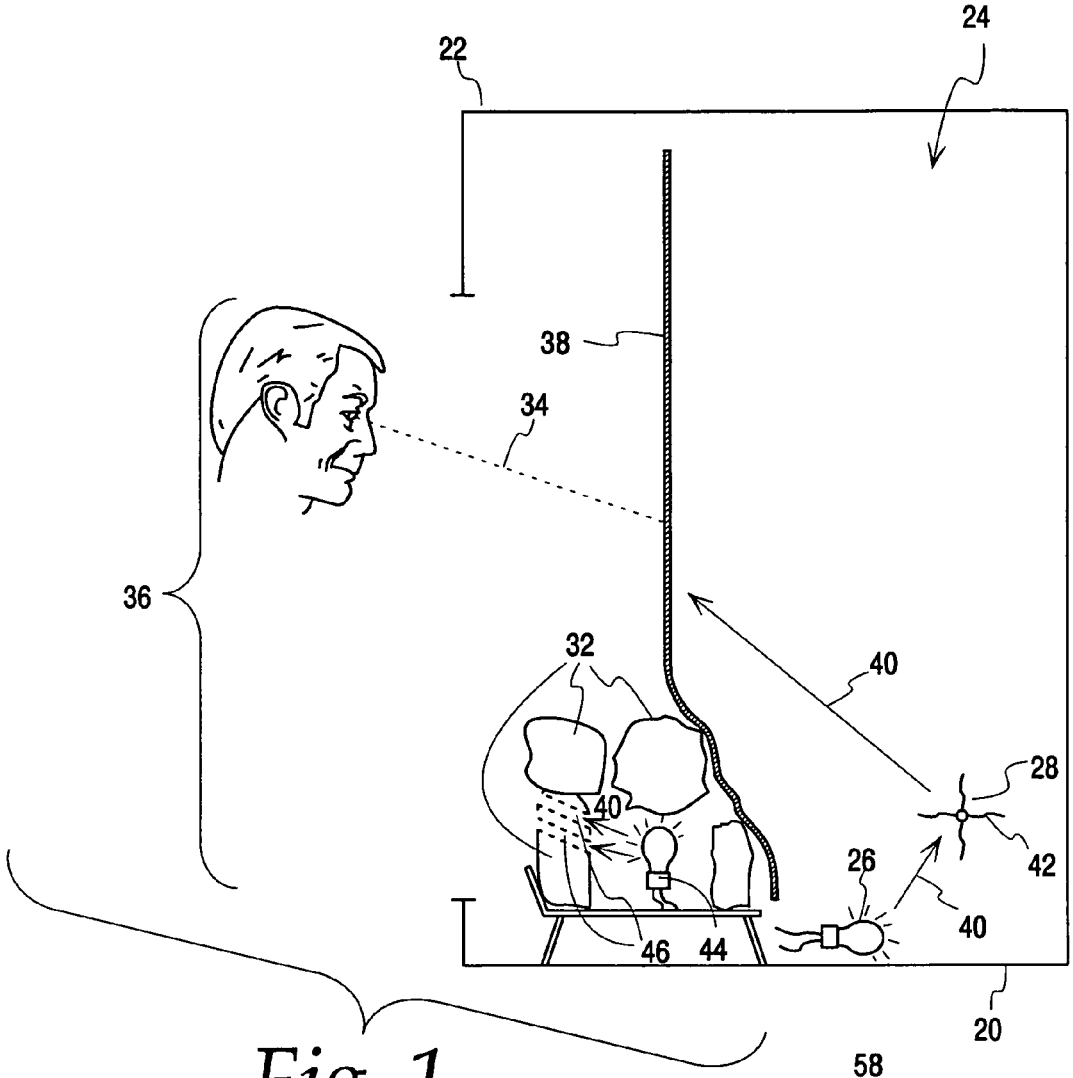
Fig. 1 Prior Art
FIG. 1 is a side elevational view, in section, of the components and operation of a prior art artificial fireplace.
Figure 2:
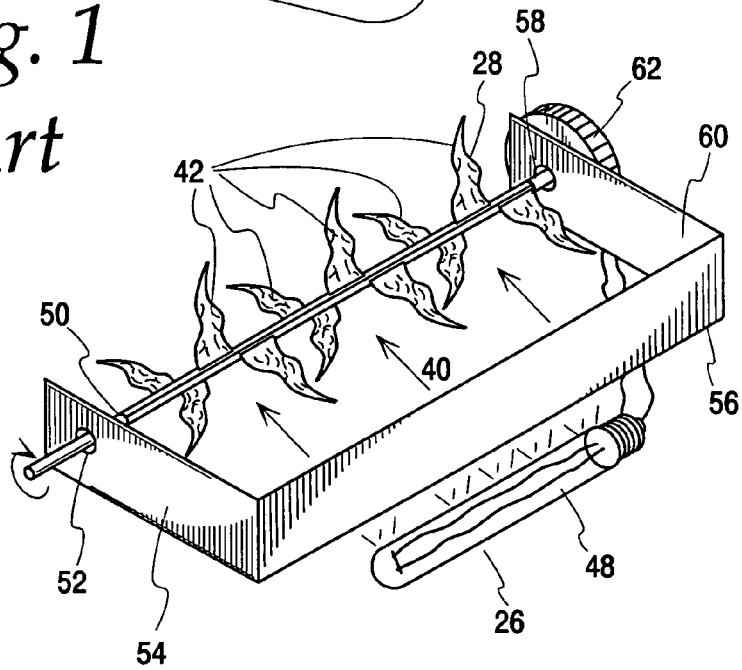
Fig. 2 Prior Art
FIG. 2 is a front perspective view of the light source and flame simulation assembly of the artificial fireplace shown in FIG. 1.
Figure 3:
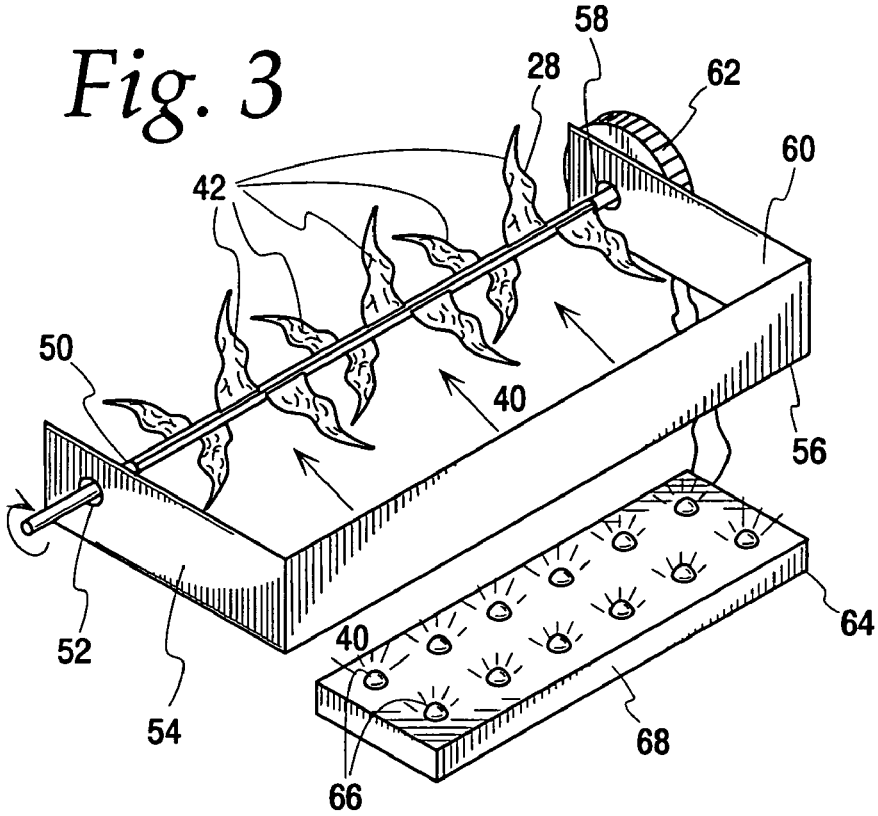
FIG. 3 is a front perspective view of the light source and flame simulation assembly of the preferred embodiment.
Figure 5:
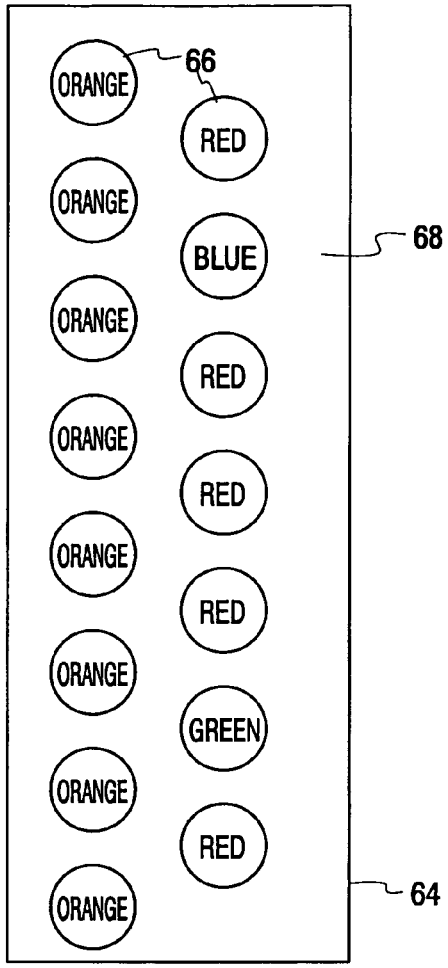
FIG. 5 is a top plan view of the light source shown in FIG. 3.

FIG. 3 illustrates a preferred embodiment that is generally similar in operation to the structure shown in FIGS. 1 and 2. One important difference between the structure shown in FIG. 3 and the one shown in FIGS. 1 and 2 is the addition of an improved light source 64. The light bulb 48 of the prior art light source 26 is replaced by a plurality of light emitting diodes (LEDs) 66 which are removably affixed to a printed circuit board (PCB) 68. The LEDs 66 and PCB 68 are operatively coupled to a suitable power source which is not pictured. A top plan view of a preferred arrangement of the LEDs 66 on the PCB 68 is illustrated in FIG. 5. The size of the PCB 68 and the number of LEDs 66 attached thereto may vary depending on the size of the housing 20. As many LEDs 66 as will fit onto the PCB 68 may be used, but fifteen LEDs 66 are used in a preferred embodiment. The LEDs 66 may be colored so as to produce a more realistic flame image on the viewing screen 38. In a preferred embodiment, eight of the LEDs 66 are orange, five are red, one is blue and one is green. Depending on the preference of the user, the orange LEDs 66 may be placed closest to the viewing screen 38 for a more orange flame image, but any color arrangement is within the scope of this invention. The individual LEDs 66 may be removed and replaced with LEDs 66 of a different color if the user wants to change the color of the image that is ultimately projected onto the viewing screen 38. Furthermore, the LEDs 66 need not be functionally identical to one another and it is possible to use LEDs 66 of different electrical characteristics without departing from the scope of this invention.

In a preferred embodiment, the rotating flame elements 42 are made of reflective aluminum, which reflects the colored light 40 from the LEDs 66 onto the viewing screen 38. The result of using LEDs 66 instead of a light bulb 48 is a more realistic, randomly-flickering flame image that is primarily reddish-orange with instances of green and blue. Additional advantages are an improved life span, less undesirable heat emitted within the artificial fireplace 22, and lower electricity consumption.

Figure 4:
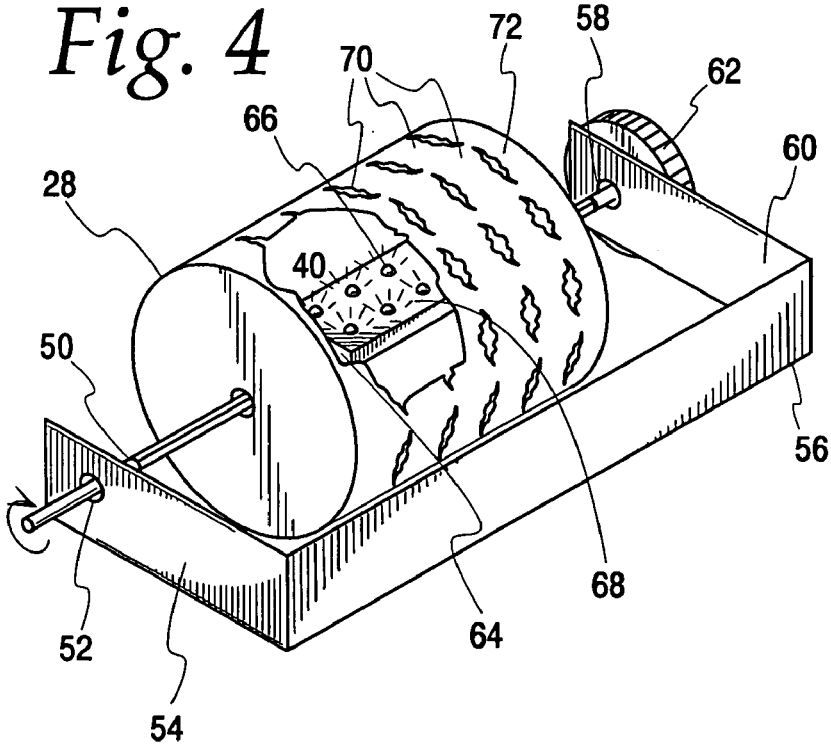
FIG. 4 is a front perspective view of the light source and flame simulation assembly of a second embodiment.

FIG. 4 illustrates an alternate embodiment of the improved light source 64 and a flame simulation assembly 28 with slit-type flame elements 70. The light source 64 in FIG. 4 operates identically to the light source 64 shown in FIG. 3, but the PCB 68 is located within a generally hollow cylinder 72 which is affixed to the shaft 50. The cylinder 72 has a number of slit-type flame elements 70 through which the light 40 emitted by the light source 64 passes. The slit-type flame elements 70 are shaped such that the light 40 passing through the cylinder 72 projects a flame-shaped image onto the viewing screen 38. The cylinder 72 rotates while the light source 64 preferably remains stationary, so the image of the light 40 passing through the slit-type flame elements 70 appears to move on the viewing screen 38.

Figure 6:
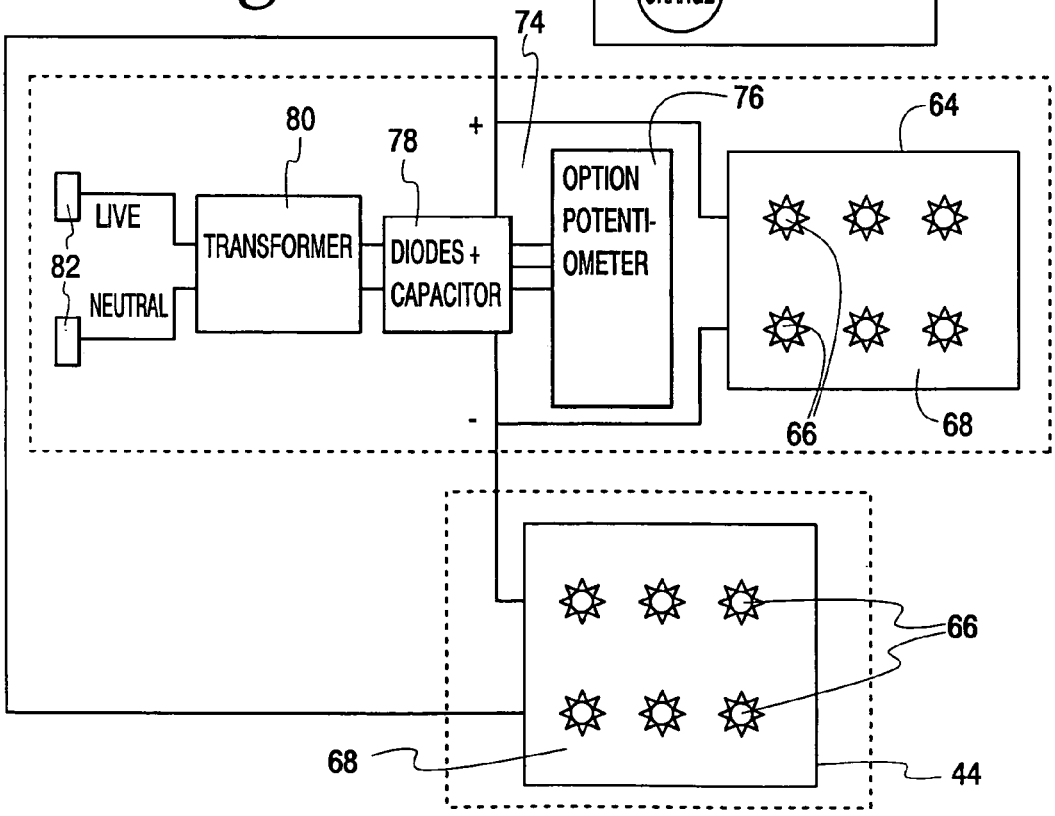
FIG. 6 is a functional block diagram of the light source shown in FIG. 3 and an optional dimmer assembly.

FIG. 6 illustrates a block diagram of an optional dimmer assembly 74 that can be used to allow selective adjustment of the brightness of the light 40 emanating from the light source 64. While the brightness of the light 40 may be selectively adjusted, each LED 66 otherwise produces a non-blinking light 40 having a generally constant brightness. The LEDs 66 and PCB 68 are operatively coupled to a potentiometer 76 which is electrically coupled to an assembly of diodes and capacitors 78 which, in turn, is electrically coupled to a transformer 80. The transformer 80 is electrically coupled to a suitable power source 82, which is typically a household electrical outlet. LEDs 66 must operate on a low voltage, otherwise they may be destroyed, so the transformer 80 steps down the voltage from the power source 82 before it is delivered to the LEDs 66. Additionally, LEDs 66 use direct current, so the assembly of diodes and capacitors 78 converts the alternating current delivered by the power source into usable direct current. The voltage delivered to the LEDs 66 through the PCB 68 can be varied by adjusting the potentiometer 76 with a suitable control assembly, which is not pictured. As the voltage delivered to the LEDs 66 through the PCB 68 varies, the intensity of the light 40 emitted by the LEDs 66 also varies which consequently affects the brightness of the image that is projected onto the viewing screen 38. The LEDs 66 may have different electrical properties, so decreasing the voltage may cause some LEDs 66 to become deactivated, while others remain lit. Similarly, for a given voltage level, different LEDs 66 may produce light 40 having a different brightness without departing from the scope of the present invention. Also shown is a fuel light source 44 that may be added to the artificial fireplace 22 in order to create the appearance of smoldering embers within the simulated fuel source 32, as described in FIG. 1. Preferably, all of the LEDs 66 of the fuel light source 44 are red. The dimmer assembly 74 may be coupled to either the light source 64 or the fuel light source 44, or it may be coupled to both of them. Additionally, there may be separate dimmer assemblies 74 coupled to the light source 64 and the fuel light source 44, so the brightness of the light which each emits can be independently adjusted.

It will be understood that the embodiments of the present invention which have been described are illustrative of some of the applications of the principles of the present invention. Numerous modifications may be made by those skilled in the art without departing from the true spirit and scope of the invention, including those combinations of features that are individually disclosed or claimed herein.

What is claimed is:

1. An artificial fireplace comprising:

a housing having an interior cavity and a viewing aperture for viewing said interior cavity;

a viewing screen disposed within said interior cavity;

a plurality of light emitting diodes disposed adjacent to said viewing screen, wherein said light emitting diodes emit a non-flickering, non-blinking light having a generally constant brightness, and wherein said light emitting diodes are removably affixed to a printed circuit board for allowing said light emitting diodes to be individually interchanged;

a power source operatively coupled to said plurality of light emitting diodes; and a flame simulation assembly disposed in a light-receiving relationship with said plurality of light emitting diodes, for receiving the light emitted by the plurality of light emitting diodes and projecting at least a portion of the light onto the viewing screen.

2. The artificial fireplace of claim 1, wherein a plurality of said light emitting diodes are colored.

3. The artificial fireplace of claim 2, wherein all of said light emitting diodes are colored.

4. The artificial fireplace of claim 1, wherein two or more of said light emitting diodes have different electrical characteristics and different brightnesses at a given voltage supplied by the power source.

5. The artificial fireplace of claim 1, wherein said flame simulation assembly includes a frame and a shaft rotatably affixed to said frame.

6. The artificial fireplace of claim 5, further comprising a control assembly for selectively adjusting a rotational speed of the shaft.

7. The artificial fireplace of claim 5, wherein said flame simulation assembly is disposed generally above said plurality of light emitting diodes.

8. The artificial fireplace of claim 5, wherein said flame simulation assembly further includes flame elements affixed to said shaft.

9. The artificial fireplace of claim 8, wherein said flame elements comprise a light-reflecting material.

10. The artificial fireplace of claim 9, wherein said light-reflecting material is aluminum.

11. The artificial fireplace of claim 5, wherein said flame simulation assembly further includes a generally hollow cylinder affixed to said shaft for housing the plurality of light emitting diodes.

12. The artificial fireplace of claim 11, wherein said cylinder further includes a plurality of light-receiving slits configured for projecting an image of one or more flames onto said viewing screen.

13. The artificial fireplace of claim 1, further comprising a dimmer assembly interconnecting said plurality of light emitting diodes and said power source for selectively adjusting the brightness of the light transmitted by said plurality of light emitting diodes.

14. An artificial fireplace comprising:

a housing having an interior cavity and a viewing aperture for viewing said interior cavity;

a simulated fuel source disposed within said interior cavity of the housing, wherein said simulated fuel source includes a plurality of apertures;

a fuel light source disposed in light-transmitting relationship to said plurality of apertures, wherein said fuel light source emits a non-flickering, non-blinking light having a generally constant brightness and comprises a plurality of light emitting diodes for projecting said light through the plurality of apertures and creating the appearance of smoldering embers within the simulated fuel source, and wherein said light emitting diodes are removably affixed to a printed circuit board for allowing said light emitting diodes to be individually interchanged; and a power source operatively coupled to said fuel light source.

15. The artificial fireplace of claim 14, wherein said fuel light source is generally disposed within said simulated fuel source.

16. The artificial fireplace of claim 14, wherein two or more of said light emitting diodes have different electrical characteristics and different brightnesses at a given voltage supplied by the power source.

17. The artificial fireplace of claim 14, wherein a plurality of said light emitting diodes are red.

18. The artificial fireplace of claim 17, wherein all of said light emitting diodes are red.

19. The artificial fireplace of claim 14, further comprising a dimmer assembly interconnecting said fuel light source and said power source for selectively adjusting the brightness of the light emitted by the fuel light source.

20. A method for simulating one or more flames in an artificial fireplace comprising the steps of:

providing a housing having an interior cavity and a viewing aperture for viewing said interior cavity;

providing a viewing screen disposed within said interior cavity;

providing a light source which emits a non-flickering, non-blinking light having a generally constant brightness, wherein said light source is disposed adjacent to said viewing screen and comprises a plurality of light emitting diodes, and wherein said light emitting diodes are removably affixed to a printed circuit board for allowing said light emitting diodes to be individually interchanged;

providing a power source operatively coupled to said light source; and projecting at least a portion of the light onto said viewing screen, wherein said portion of the light simulates one or more flames.

21. The method of claim 20, wherein said portion of the light is projected by a rotatable flame simulation assembly for simulating movement of the one or more flames.

22. The method of claim 20, wherein said plurality of light emitting diodes comprise a number of light emitting diodes that are red or orange and a lesser number of light emitting diodes that are green or blue.

* * * * *